US007936324B2

(12) United States Patent
Oh

(10) Patent No.: US 7,936,324 B2
(45) Date of Patent: May 3, 2011

(54) LIQUID CRYSTAL DISPLAY DEVICE AND DRIVING METHOD THEREOF

(75) Inventor: Eun-Jung Oh, Suwon-si (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 1103 days.

(21) Appl. No.: 11/132,065

(22) Filed: May 18, 2005

(65) Prior Publication Data

US 2005/0270262 A1 Dec. 8, 2005

(30) Foreign Application Priority Data

Jun. 3, 2004 (KR) ..... 10-2004-0040290

(51) Int. Cl.
*G09G 3/36* (2006.01)

(52) U.S. Cl. ..... 345/89; 345/690

(58) Field of Classification Search ..... 345/89, 345/690

See application file for complete search history.

(56) References Cited

U.S. PATENT DOCUMENTS

| | | | | |
|---|---|---|---|---|
| 2001/0038372 | A1* | 11/2001 | Lee | 345/89 |
| 2002/0030652 | A1 | 3/2002 | Shibata et al. | |
| 2002/0135553 | A1 | 9/2002 | Nagai et al. | |
| 2002/0196224 | A1* | 12/2002 | Ham | 345/94 |
| 2004/0252111 | A1* | 12/2004 | Cheon et al. | 345/204 |
| 2005/0062764 | A1* | 3/2005 | Park et al. | 345/690 |

FOREIGN PATENT DOCUMENTS

| | | | |
|---|---|---|---|
| CN | 1310434 | A | 8/2001 |
| CN | 1351324 | A | 5/2002 |
| CN | 1391204 | | 1/2003 |
| JP | 2001-174784 | | 6/2001 |
| JP | 2003-76341 | | 3/2003 |
| JP | 2004-61670 | | 2/2004 |
| KR | 2002-0010653 | | 2/2002 |
| KR | 2002-0028781 | | 4/2002 |
| WO | WO 03/098588 | A1 | 11/2003 |

OTHER PUBLICATIONS

Korean Patent Abstracts for Publication No. 1020020028781; Date of publication of application Apr. 17, 2002, in the name of Akihito Jinda et al.

Patent Abstracts of Japan, Publication No. 2001-174784; Date of Publication: Jun. 29, 2001; in the name of Tomohiko Sato.

Patent Abstracts of Japan, Publication No. 2003-076341; Date of Publication: Mar. 14, 2003; in the name of Kazuhiro Yamada.

Patent Abstracts of Japan, Publication No. 2004-061670; Date of Publication: Feb. 26, 2004; in the name of Hiroyuki Sekine.

* cited by examiner

*Primary Examiner* — Amare Mengistu
*Assistant Examiner* — Insa Sadio
(74) *Attorney, Agent, or Firm* — Christie, Parker & Hale, LLP

(57) ABSTRACT

A driving method of a liquid crystal display (LCD) device including a light source controller controlling red, green, and blue lights to be sequentially transmitted through a pixel formed by a liquid crystal disposed between a first substrate and a second substrate. First grayscale data is applied to the pixel. Second grayscale data to be applied to the pixel is compensated by changing the second grayscale data to third grayscale data corresponding to the first grayscale data and the second gray scale data. Then the third grayscale data is applied to the pixel.

20 Claims, 10 Drawing Sheets

*FIG. 7A*

| Grayscale | Measured luminance value |
|---|---|
| 1 | a |
| 2 | b |
| 3 | c |
| 4 | d |
| ... | ... |
| 256 | z |

*FIG. 7B*

| First grayscale | Second grayscale | measured luminance value of second grayscale | Symmetric grayscale |
|---|---|---|---|
| 1 | 1 | a | 1 |
| | 2 | b | 2 |
| | 3 | d | 4 |
| | ... | ... | ... |
| | 256 | x | 254 |
| 2 | 1 | d | 4 |
| | 2 | h | 7 |
| | 3 | p | 9 |
| | ... | ... | ... |
| | 256 | q | 250 |
| ... | ... | ... | ... |
| 256 | ... | ... | ... |

LIQUID CRYSTAL DISPLAY DEVICE AND DRIVING METHOD THEREOF

CROSS REFERENCE TO RELATED APPLICATION

This application claims priority to and the benefit of Korean Patent Application No. 10-2004-0040290 filed on Jun. 3, 2004 in the Korean Intellectual Property Office, the entire content of which is incorporated herein by reference.

BACKGROUND OF THE INVENTION

1. Field of the Invention

The present invention relates to a liquid crystal display device, and more particularly, to a field sequential driving method and a liquid crystal display device using the same.

2. Description of the Related Art

Recently, personal computers and televisions have become lightweight and flat, and accordingly display devices are being required to be lightweight and flat. Thus, flat panel displays including a liquid crystal display (LCD) have been developed for use instead of a cathode ray tube (CRT).

An LCD device utilizes two substrates and a liquid crystal material having an anisotropic dielectric constant injected between the substrates, in which an electric field is applied to the liquid crystal material. The amount of light from an external light source transmitted through the substrates is controlled by intensity of the electric field to obtain a desired image signal.

Such an LCD is the most common type of flat panel displays, and especially, a thin film transistor (TFT)-LCD using a TFT as a switching element is most commonly used.

Each pixel in the TFT-LCD can be modeled as a capacitor having a liquid crystal as a dielectric material, that is a liquid crystal capacitor. An equivalent circuit diagram of such a pixel is shown in FIG. 1.

As shown in FIG. 1, each pixel in an LCD device includes a TFT 10 having a source electrode and a gate electrode respectively coupled to a data line Dm and a scan line Sn, a liquid capacitor Cl coupled between a drain electrode of the TFT 10 and a common voltage source Vcom, and a storage capacitor Cst coupled to the drain electrode of the TFT 10.

As can be seen in FIG. 1, the TFT 10 is turned on when a scan signal is applied to the scan line, and a data voltage Vd supplied to the data line Dm is applied to each pixel (not shown) through the TFT 10. Then, an electric field corresponding to a difference between a pixel voltage Vp and the common voltage Vcom is applied to a liquid crystal (equivalently shown as a liquid crystal capacitor Cl in FIG. 1), and light transmittance is determined by intensity of the electric field. Here, the pixel voltage Vp is maintained for one frame scan or one field, and the storage capacitor Cst is auxiliarily used to maintain the pixel voltage Vp applied to the pixel electrode.

In general, methods of displaying a color image on an LCD device can be classified into a color filter method and a field sequential driving method.

An LCD device employing the color filter method forms a color filter layer having 3 primary colors (red, green, and blue) on one of substrates, and a desired color is displayed by controlling the amount of light transmitted to the color filter. An LCD employing the color filter method transmits light emitted from a light source to red, green, and blue color filters, and the desired color can be expressed by controlling the amount of red, green, and blue lights transmitted through the red, green, and blue color filters and combining these lights.

Such an LCD device displaying colors using a single-light source and three color filter layers requires three times or more pixels compared to displaying monochrome to respectively correspond to red, green, and blue color areas. Accordingly, a sophisticated manufacturing technology is required to obtain a high resolution image.

Moreover, adding a separate color filter layer on the substrate of the LCD causes the manufacturing of the LCD to be complicated, and light transmittance of the color filter must be considered as well.

On the other hand, an LCD employing the field sequential driving method periodically and sequentially turns on/off independent red, green, and blue signals, and synchronously applies a corresponding color signal to the pixel in accordance with the turn on/off period to thereby obtain a full-colored image. In other words, the field sequential driving method uses persistence of vision to display a colored image by way of outputting the red, green, and blue (RGB) lights from RGB light sources (i.e., backlights) and time-dividing the RGB lights, and sequentially displaying the time-divided RGB lights on a pixel instead of dividing the pixel into three pixels for red, green, and blue colors.

The field sequential driving method can be classified into an analog driving method or a digital driving method.

The analog driving method predetermines a plurality of grayscale voltages corresponding to a total number of grayscales to be displayed, and selects a grayscale voltage corresponding to grayscale data from the plurality of grayscale voltages to drive a liquid crystal panel to thereby express grayscales using the amount of transmitted light corresponding to the grayscale voltage applied to the liquid crystal panel.

FIG. 2 illustrates a driving voltage and the amount of transmitted light according to an LCD panel employing a conventional analog driving method. As shown therein, the driving voltage represents a voltage applied to the liquid crystal, and the optical transmittance represents a ratio of the amount of light transmitted through the liquid crystal to the amount of incident light. In other words, the optical transmittance represents a ratio of the amount of light transmitted through the liquid crystal with respect to the degree of distortion of the liquid crystal.

Referring to FIG. 2, a driving voltage of V11 level is applied to the liquid crystal in an R-field period Tr for displaying a red color and the amount of light transmitted through the liquid crystal corresponds to the driving voltage. In a G-field period Tg for displaying a green color, a V12-level driving voltage is applied and a corresponding amount of light is transmitted through the liquid crystal. Further, in the B-field period Tb for displaying a blue color, a V13 level driving voltage is applied and a corresponding amount of light is transmitted through the liquid crystal. By combining the red, green, and blue lights respectively transmitted through the Tr, Tg, and Tb, a desired colored image can be displayed.

On the other hand, the digital driving method regulates driving voltages applied to the liquid crystal and controls a voltage application time to thereby express grayscales. According to the digital driving method, the grayscales are expressed by maintaining the regulated driving voltage and adjusting a timing or duration of the voltage application to control an accumulated amount of light transmitted through the liquid crystal.

FIG. 3 illustrates waveforms that explain a driving method of an LCD device employing a conventional digital driving method. Waveforms of a driving voltage in accordance with a predetermined number of bits of driving data and corresponding optical transmittance of a liquid crystal are illustrated.

As shown in FIG. 3, a 7-bit digital signal is provided as grayscale waveform data for each grayscale, and a corresponding grayscale waveform is applied to the liquid crystal. The optical transmittance of the liquid crystal is determined according to the applied grayscale waveform, thereby expressing the grayscales.

According to a conventional field sequential driving method, a measured value of a current grayscale (e.g., grayscale R) can be varied depending on a previous grayscale (e.g., grayscale B), and thus it is difficult to express accurate grayscale levels. In other words, a pixel voltage Vp supplied to a current liquid crystal is determined by grayscale voltages supplied to both a current field (e.g., field R) and a previous field (e.g., field B).

In particular, a value of the grayscale may be suddenly dropped because the field sequential method applies the grayscale voltage to one pixel in sequence of the field R, field G, and field B. Accordingly, previous grayscale data affects representing current grayscale data.

In an LCD device employing a general filter method, one pixel is divided into three sub pixels, and the grayscale data is applied to each sub pixel in accordance with the following sequence R1->R2, G1->G2, and B1->B2, whereas the field sequential driving method applies the grayscale data to one pixel in accordance with the following sequence R1->G1->B1->R2->G2->B2, thereby causing a sudden change of the grayscale. In a sequentially inputted image signal, the grayscale data applied to the R2 in sequence of R1 is generally not suddenly changed according to its characteristic, but R1, G1, and B1 data for expressing different colors may be suddenly changed. When grayscale data is suddenly changed in one pixel, the previous grayscale data greatly affects the currently displayed grayscale.

SUMMARY OF THE INVENTION

Accordingly, in exemplary embodiments of the present invention, an LCD device employing a field sequential driving method is provided. The LCD device compensates a false grayscale of a current pixel due to a previous pixel in a conventional LCD device.

In an exemplary embodiment of the present invention, a driving method of an LCD device is provided. The LCD device has a pixel formed by a liquid crystal disposed between a first substrate and a second substrate. Red, green, and blue lights are sequentially transmitted to the pixel. In the driving method, first grayscale data is applied to the pixel, second grayscale data to be applied to the pixel is compensated by changing the second grayscale data to third grayscale data corresponding to the first grayscale data and the second grayscale data, and the third grayscale data is applied to the pixel.

In another exemplary embodiment of the present invention, a driving method of an LCD device having first and second pixels formed by a liquid crystal disposed between a first substrate and a second substrate, is provided. Red, green, and blue lights are sequentially transmitted to the pixels. In the driving method, first grayscale data is applied to the first pixel, and second grayscale data is applied to the second pixel. When grayscale data to be applied to the first pixel is third grayscale data, the third grayscale data is compensated to generate fourth grayscale data corresponding to the first grayscale data and the third grayscale data, and the fourth grayscale data is applied to the first pixel. When grayscale data to be applied to the second pixel is the third grayscale data, the third grayscale data is compensated to generate fifth grayscale data corresponding to the second grayscale data and the third grayscale data, and the fifth grayscale data is applied to the second pixel. The fifth grayscale data is different from the fourth grayscale data.

In yet another exemplary embodiment of the present invention, an LCD device is provided. The LCD device includes an LCD panel, a gate driver, a grayscale compensator, a data driver, and a light source. The LCD panel has a plurality of scan lines, a plurality of data lines, and a plurality of pixels. The plurality of scan lines transmit scan signals. The plurality of data lines cross the scan lines, while being insulated from the scan lines. The plurality of pixels are formed in areas defined by the scan lines and the data lines, and have switches respectively coupled to the scan lines and the data lines. The gate driver sequentially supplies the scan signals to the scan lines. The grayscale compensator compensates grayscale data to be applied to a current pixel of the pixels based on grayscale data applied to a previous pixel of the pixels. The data driver drives an associated one of the data lines corresponding to the grayscale data compensated by the grayscale compensator. The light source sequentially emits red, green, and blue lights to the pixels.

BRIEF DESCRIPTION OF THE DRAWINGS

The accompanying drawings, together with the specification, illustrate exemplary embodiments of the present invention, and, together with the description, serve to explain the principles of the present invention.

FIGS. 7A and 7B illustrate a method of compensating grayscale data of a current pixel corresponding to grayscale data of a previous pixel.

DETAILED DESCRIPTION

Figure 1:
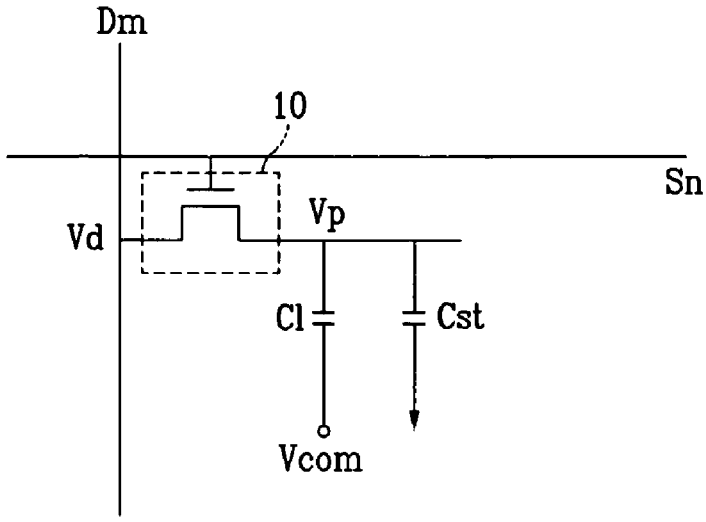
FIG. 1 (Prior Art)
FIG. 1 illustrates a pixel of a conventional TFT-LCD.
Figure 2:
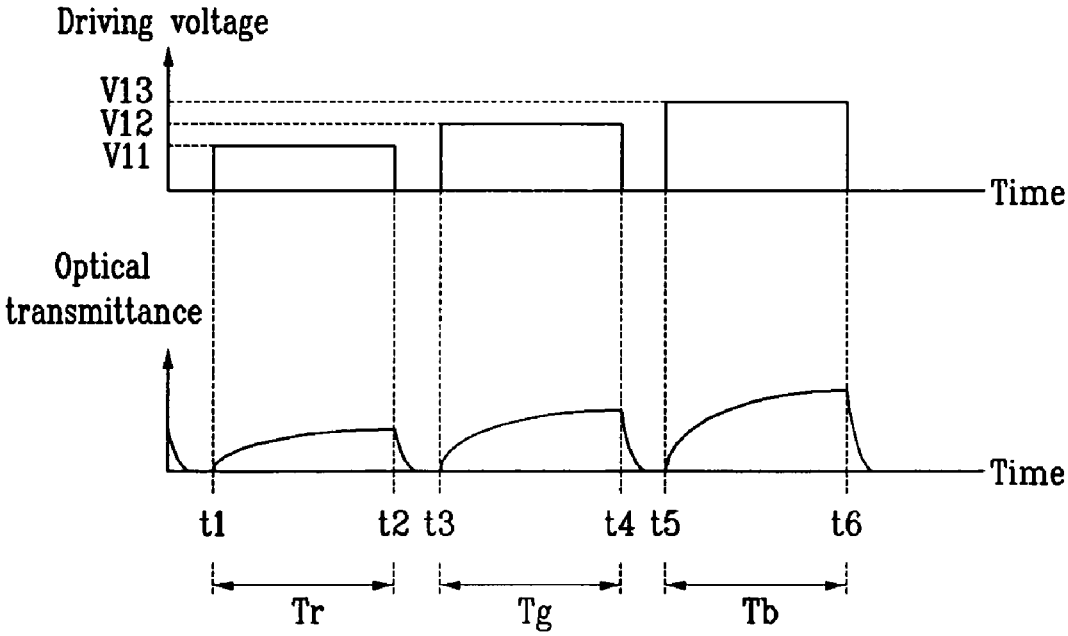
FIG. 2 (Prior Art)
FIG. 2 is a waveform diagram illustrating a driving method of an LCD device employing a conventional digital method.
Figure 3:
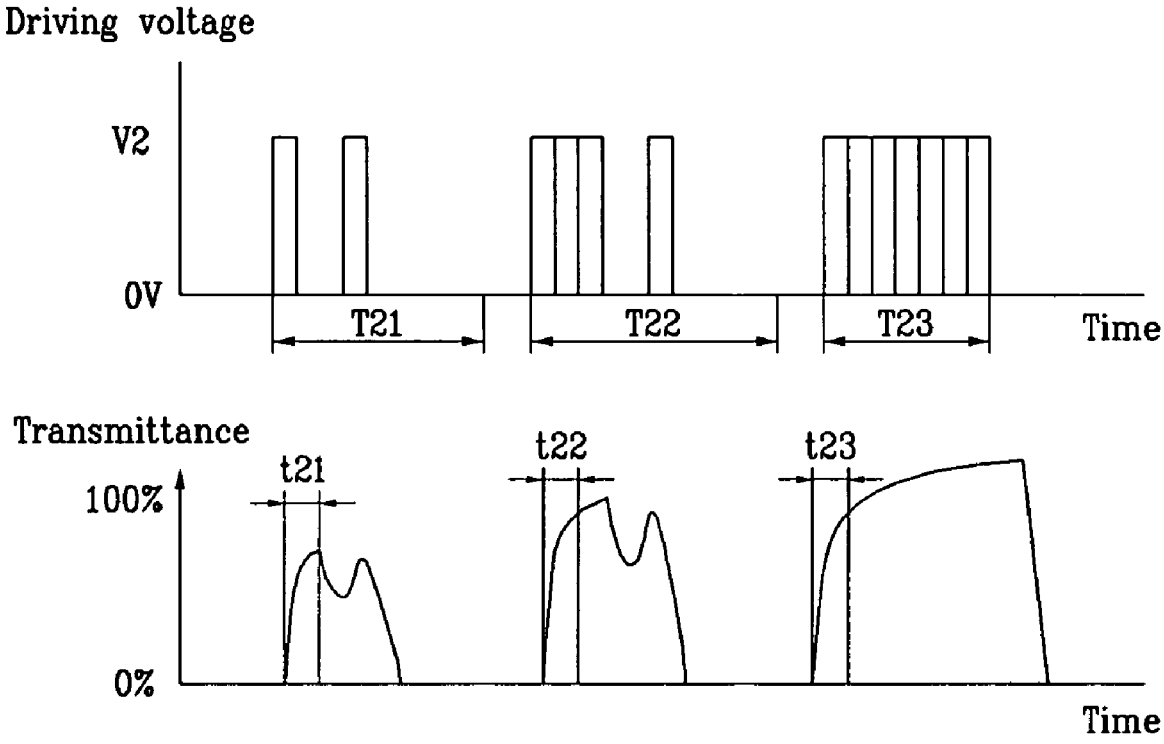
FIG.3(Prior Art)
FIG. 3 is a waveform diagram illustrating a driving method of an LCD device employing a conventional analog method.

In the following detailed description, only certain exemplary embodiments of the present invention are shown and described, simply by way of illustration. As those skilled in the art would realize, the described embodiments may be modified in various different ways, all without departing from the spirit or scope of the present invention. Accordingly, the drawings and description are to be regarded as illustrative in nature, and not restrictive. There may be parts shown in the drawings, or parts not shown in the drawings, that are not discussed in the specification as they are not essential to a complete understanding of the invention. Like reference numerals designate like elements.

Throughout the specification, the word "a current pixel" refers to a pixel in a current time period (t), and "a previous pixel" refers to a pixel in a previous time period (t−1). In addition, "a grayscale voltage" refers to voltages at different levels, and "a grayscale waveform" refers to a waveform having a width of voltage-on and a width of voltage-off that can be different.

Referring now to FIGS. 4 to 7, a driving method according to a first exemplary embodiment of the present invention will be described hereinafter. The driving method according to the first exemplary embodiment of the present invention relates to an analog field sequential driving method.

Figure 4:
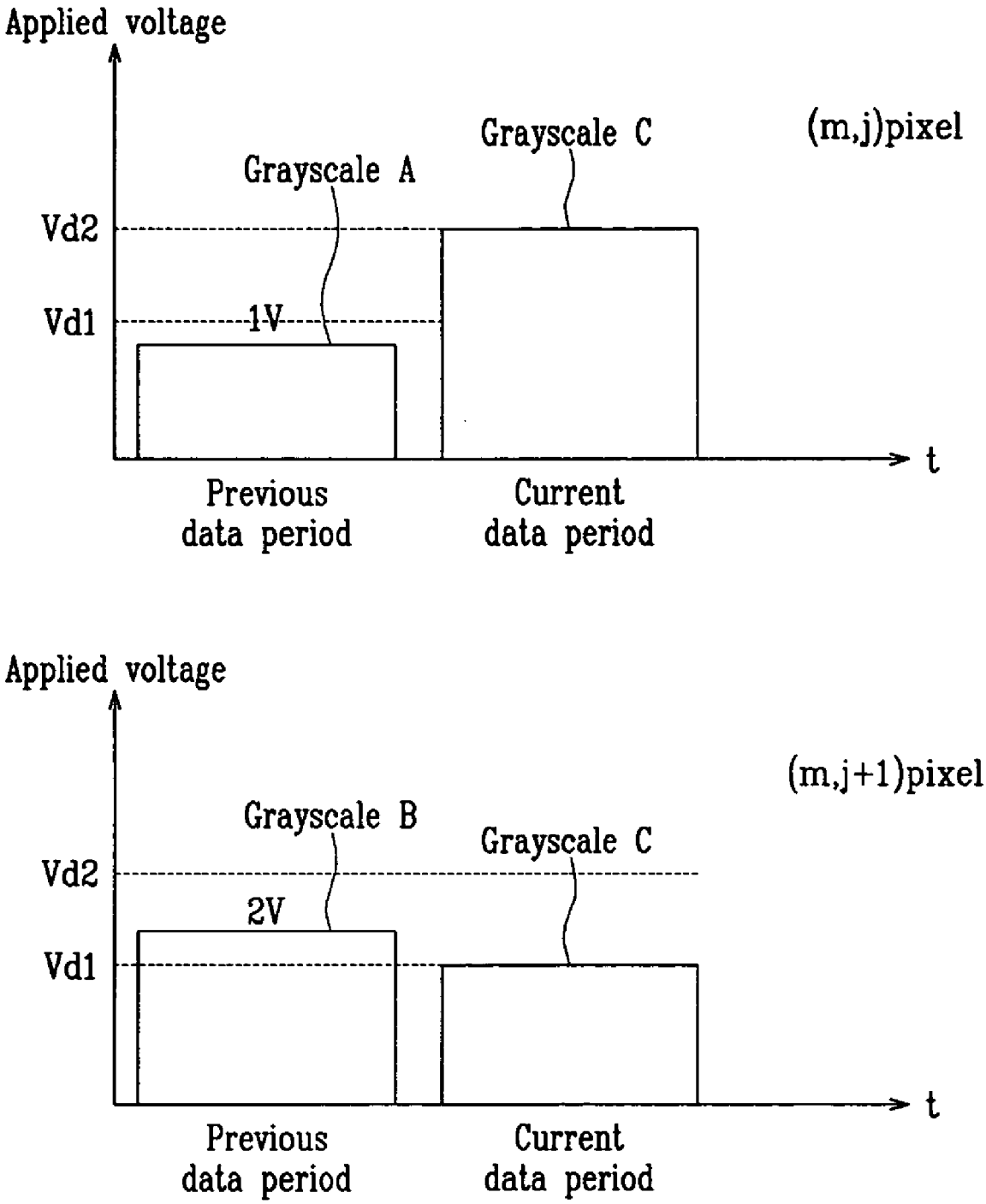
FIG. 4 illustrates a driving method of an LCD device according to a first exemplary embodiment of the present invention.

Referring to FIG. 4, a grayscale voltage $Vd_2$ applied to (m, j) pixel (that is, a pixel in an area defined by a data line Dm and a scan line Sj) and a grayscale voltage Vd1 applied to (m, j+1) pixel (that is, a pixel in an area defined by the data line Dm and a scan line Sj+1) for displaying a current red light are determined by grayscale data applied to a previous pixel (used to display blue). Here, an assumption is made that the grayscales to be applied to the (m,j) pixel for the red light and (m,j+1) pixel are both set to be grayscale C, and voltages of the previous pixel are set to be 1V and 2V, respectively.

In detail, the (m, j) pixel and the (m,j+1) pixel for the red light are set to display the grayscale C, and the grayscale of the previous pixel is used in determining a grayscale of the current pixel according to the first exemplary embodiment of the present invention. In the case where a relatively low voltage (e.g., 1V) is applied to a previous pixel of the (m, j) pixel, a relatively high voltage Vd2 is applied to a current data period to display the grayscale C. However, in the case where a relatively high voltage (e.g., 2V) is applied to the previous pixel of the (m, j+1) pixel, a relatively low voltage Vd1 is applied to the current data period to display the grayscale C. Luminance of a previous pixel is more likely to affect the expression of a grayscale of a current pixel when a relatively high voltage is applied to a previous pixel compared to when a relatively low voltage is applied thereto. Such influence by the luminance of the previous pixel can be compensated by applying a relatively low voltage to the current pixel. In other words, when the voltage applied to the previous pixel corresponds to the grayscale of A or B, a voltage which is different from the voltage applied to the previous pixel is applied to express a natural grayscale C in the current pixel. Since expression of the grayscale of the current pixel is influenced by the grayscale of the previous pixel, the grayscale voltage of the current pixel varies depending on the grayscale (e.g., A or B) of the previous pixel.

Therefore, original grayscale data (e.g., the grayscale C) of the current pixel is changed to another grayscale depending on the grayscale data of the previous pixel. Hence, the grayscale voltage applied to the current pixel is determined based on the grayscale of the previous pixel in FIG. 4. Thus, the grayscale voltages Vd1 and Vd2 applied to the grayscale data of the current pixel correspond to the changed grayscale data.

According to the first exemplary embodiment of the present invention, the grayscale data of the current pixel is changed depending on the grayscale of the previous pixel and accordingly the grayscale voltage applied to the current pixel can be varied to thereby express a more accurate grayscale.

Figure 5:
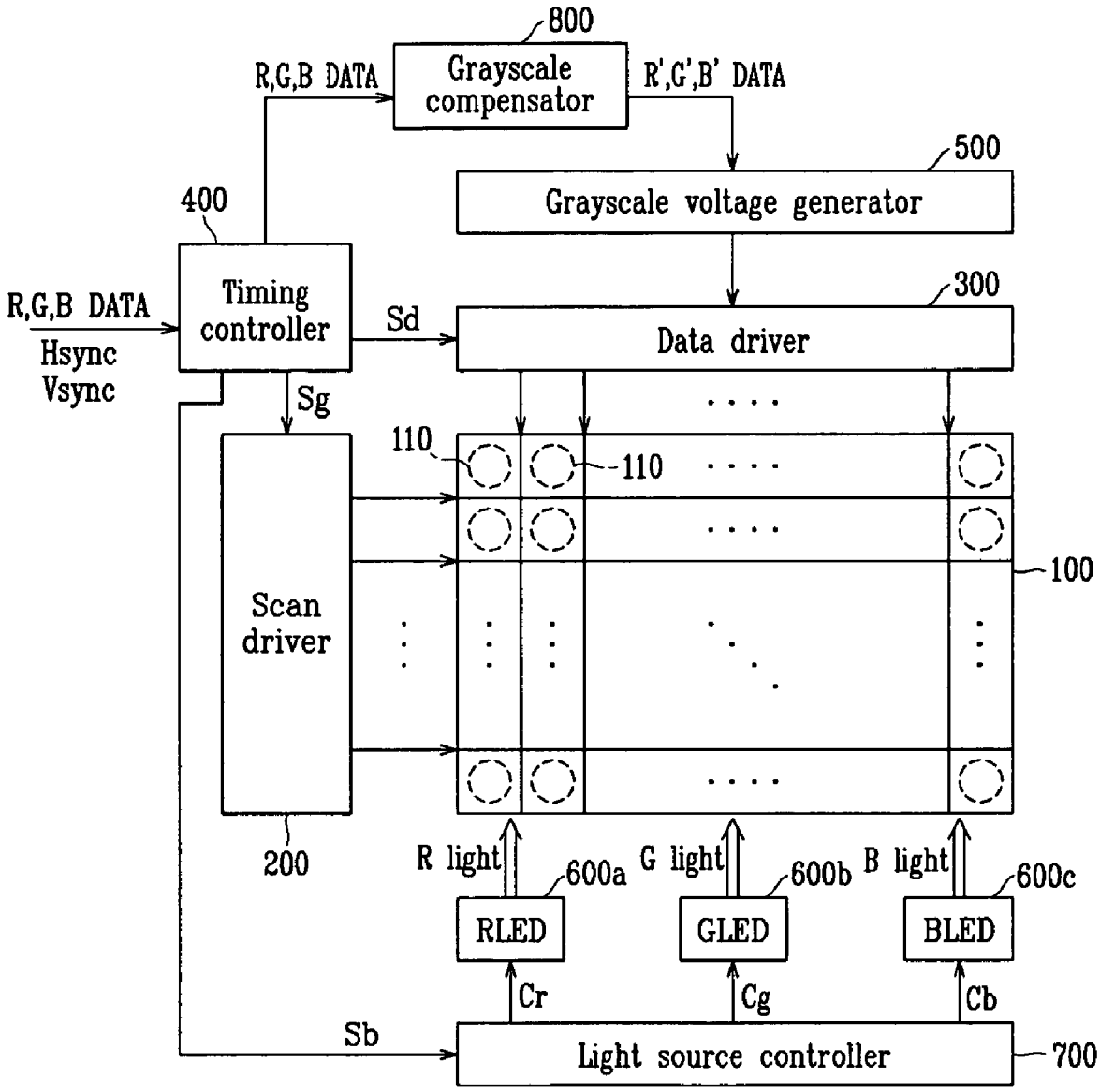
FIG. 5 and FIG. 6 illustrate the LCD device according to the first exemplary embodiment of the present invention.
Figure 6:
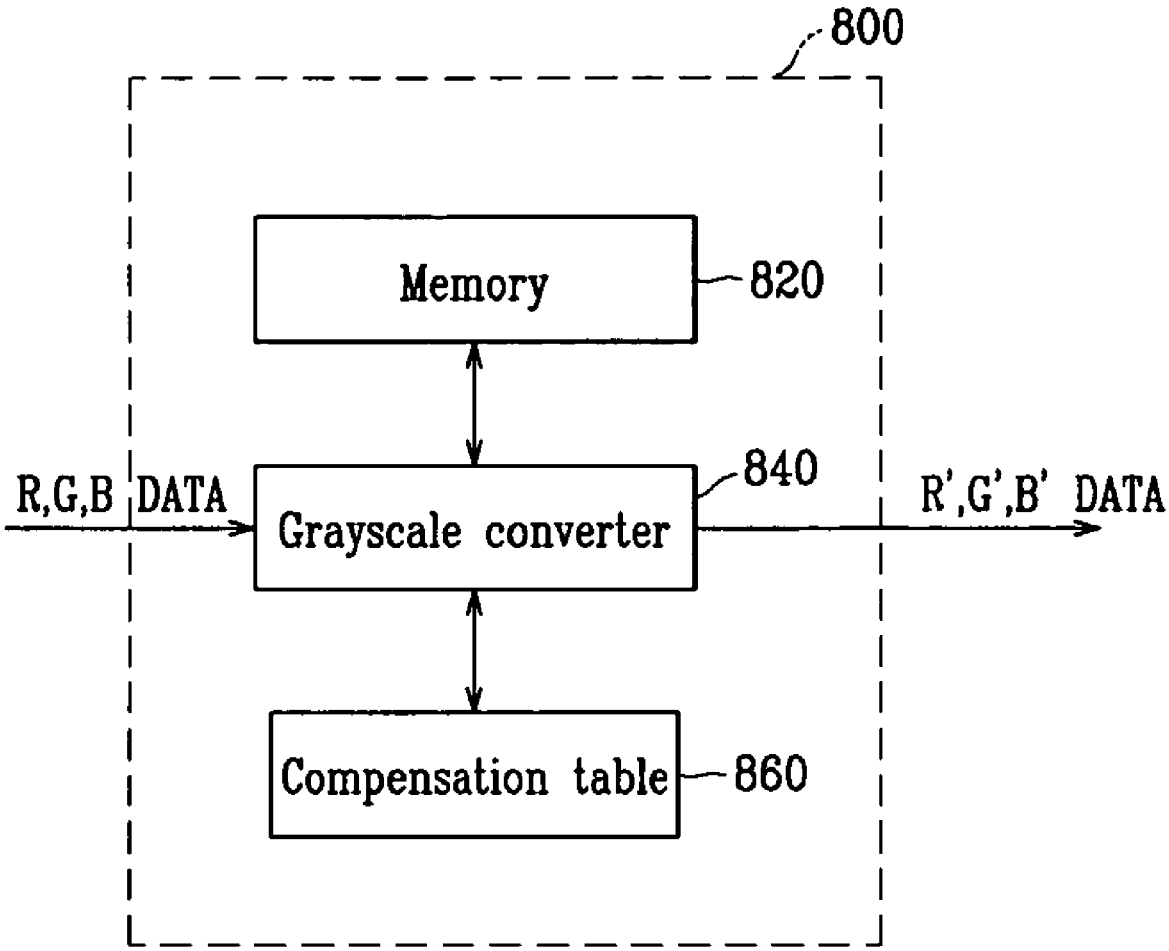

FIG. 5 and FIG. 6 show an LCD device which changes current grayscale data in accordance with a grayscale of a previous pixel according to the first exemplary embodiment of the present invention.

As shown in FIG. 5, the LCD device according to the first exemplary embodiment of the present invention includes an LCD panel 100, a scan driver 200, a data driver 300, a grayscale voltage generator 500, a timing controller 400, a red light emitting diode (LED) 600*a* for outputting a red light, a green LED 600*b* for outputting a green light, a blue LED 600*c* for outputting a blue light, a light source controller 700, and a grayscale compensator 800. The LEDs could be any suitable LEDs, such as organic LEDs (OLEDs), or any other suitable light sources.

The LCD device 100 includes a plurality of scan lines for transmitting a gate-on signal, and a plurality of data lines crossing the plurality of scan lines while being insulated from the scan lines, and for transmitting a grayscale data voltage and a reset voltage as grayscale data. A plurality of pixels 110 arranged in a matrix format are surrounded by the scan lines and the data lines. Each pixel includes a thin film transistor TFT (not shown) having a gate electrode and a source electrode respectively coupled to the scan lines and the data lines, a capacitor (not shown) coupled to a drain electrode of the TFT, and a storage capacitor (not shown).

The scan driver 200 sequentially applies a scan signal to the scan lines and turns on the TFT having the gate electrode coupled to the scan line to which the scan signal is applied.

The timing controller 400 receives grayscale data signals R, G, B DATA and horizontal/vertical synchronization signals from an external device or a graphic controller (not shown) and supplies necessary signals Sg, Sd and Sb to the scan driver 200, the data driver 300, and the light source controller 700, respectively, and the grayscale data signals R, G and B DATA to the grayscale compensator 800. The grayscale compensator 800 according to the first exemplary embodiment of the present invention compensates grayscale data of a current pixel in accordance with grayscale data of a previous pixel, and transmits the compensated grayscale data R', G', and B' DATA to the grayscale voltage generator 500.

The grayscale voltage generator 500 generates a grayscale voltage corresponding to the compensated grayscale data R', G', and B' DATA and supplies the grayscale voltage to the data driver 300. The data driver 300 applies the grayscale voltage outputted from the grayscale voltage generator 500 to an associated data line.

The LEDs 600*a*, 600*b*, and 600*c* respectively emit red, green, and blue lights to the LCD panel 100, and the light source controller 700 controls the timing for turning on the LEDs 600*a*, 600*b*, and 600*c*. According to exemplary embodiments of the present invention, LEDs are used as the backlights, but the backlights are not limited to the LEDs, and any suitable light sources can be used.

As can be seen in FIG. 6, the grayscale compensator 800 according to the first exemplary embodiment of the present invention includes a memory 820, a grayscale converter 840, and a compensation table 860.

The memory 820 stores grayscale data of a previous pixel. In the field sequential driving method, the grayscale data of the previous pixel is set to be Bn−1 in the case where grayscale data of a current pixel is set to be Rn, whereas the grayscale data of the previous pixel is set to be Rn in the case where the grayscale data of the current pixel is set to Gn.

The grayscale converter 840 receives grayscale data of a current pixel (e.g., Rn DATA), reads grayscale data of a previous pixel (e.g., Bn−1) stored in the memory 820, selects compensated grayscale data Rn' DATA corresponding to the grayscale data of the current pixel (e.g., Rn) and the grayscale data of the previous pixel (e.g., Bn−1), and outputs compensated grayscale data Rn' DATA. In this manner, the grayscale converter 840 receives the grayscale data R, G and B DATA and outputs compensated grayscale data R', G' and B' DATA using the previous gray scale data stored in the memory 820.

The compensation table 860 stores compensated grayscale data corresponding to the grayscale data of the previous pixel and the grayscale data of the current pixel, in a table format.

FIGS. 7A and 7B show a method for converting grayscale data of the current pixel corresponding to the grayscale data of the previous pixel.

FIG. 7A shows measured luminance values corresponding to each grayscale level, and FIG. 7B shows a matching grayscale between a measured luminance value of a second grayscale and a corresponding luminance value in FIG. 7A when a first grayscale (grayscale data of a previous pixel) and a consecutive second grayscale (grayscale data of a current pixel) are applied. Here, the matching grayscale refers to a grayscale expressed by the measured luminance value of the second grayscale. Referring to FIG. 7B, the measured luminance value of the second grayscale is set to 'b' when the first grayscale is set to be '1' and the second grayscale is set to be '2', and accordingly a corresponding grayscale becomes '2'. Therefore, the matching grayscale becomes 2 when a grayscale of the previous grayscale is set to '1', and a grayscale of the second grayscale is set to '2'. Meanwhile, in the case where a measured luminance value of the second grayscale is 'd' when the first grayscale is set to '1' and the second grayscale is set to '3', a corresponding matching grayscale becomes '4'. In other words, the luminance value of the second grayscale '3' consecutive to the first grayscale '1' is measured to be 'd' instead of 'c', and thus a corresponding matching grayscale becomes '4'. Therefore, the second grayscale '3' which is consecutive to the first grayscale 1 is compensated to be lower than it is supposed to be (this can be experimentally set) and accordingly a lower grayscale voltage is applied thereto so that the second grayscale '3' in FIG. 7B can express an original luminance value of the grayscale 3 in FIG. 7A. Further, in the case where a luminance value of the second grayscale '1' is measured to be 'd' when the first grayscale is set to '2' and the second grayscale is set to '1', a corresponding matching grayscale becomes '4' with reference to FIG. 7A. Therefore, when the second grayscale '1' consecutive to the first grayscale '2' is applied, the second grayscale '1' is compensated to be lower than it is supposed to be, and a lower grayscale voltage corresponding to the compensated grayscale data is applied thereto.

Further, when the consecutive second grayscale is set to be '1', and the first grayscale is set to be '1' or '2', luminance values of each of the second grayscales are respectively measured to be 'a' and 'd', as shown in FIG. 7B. Thus, when the first grayscale is set to be '2' and the second grayscale is set to be '1', the second grayscale is converted to a relatively lower grayscale compared to when the first grayscale is set to be '1' and the second grayscale is set to be '1' to thereby compensate the highly measured luminance value of a second grayscale. In other words, the luminance value of the second grayscale is measured to be higher when the second grayscales are the same and the first grayscale is high. In such a method according to FIGS. 7A and 7B, a compensation grayscale table corresponding to grayscale data of a previous pixel and grayscale data of a current pixel is predetermined and stored in the compensation table 860.

Now, a driving method according to a second exemplary embodiment of the present invention will be described with reference to FIG. 8, FIG. 9 and FIG. 10. The driving method according to the second exemplary embodiment of the present invention is related to a digital field sequential driving method.

Figure 8:
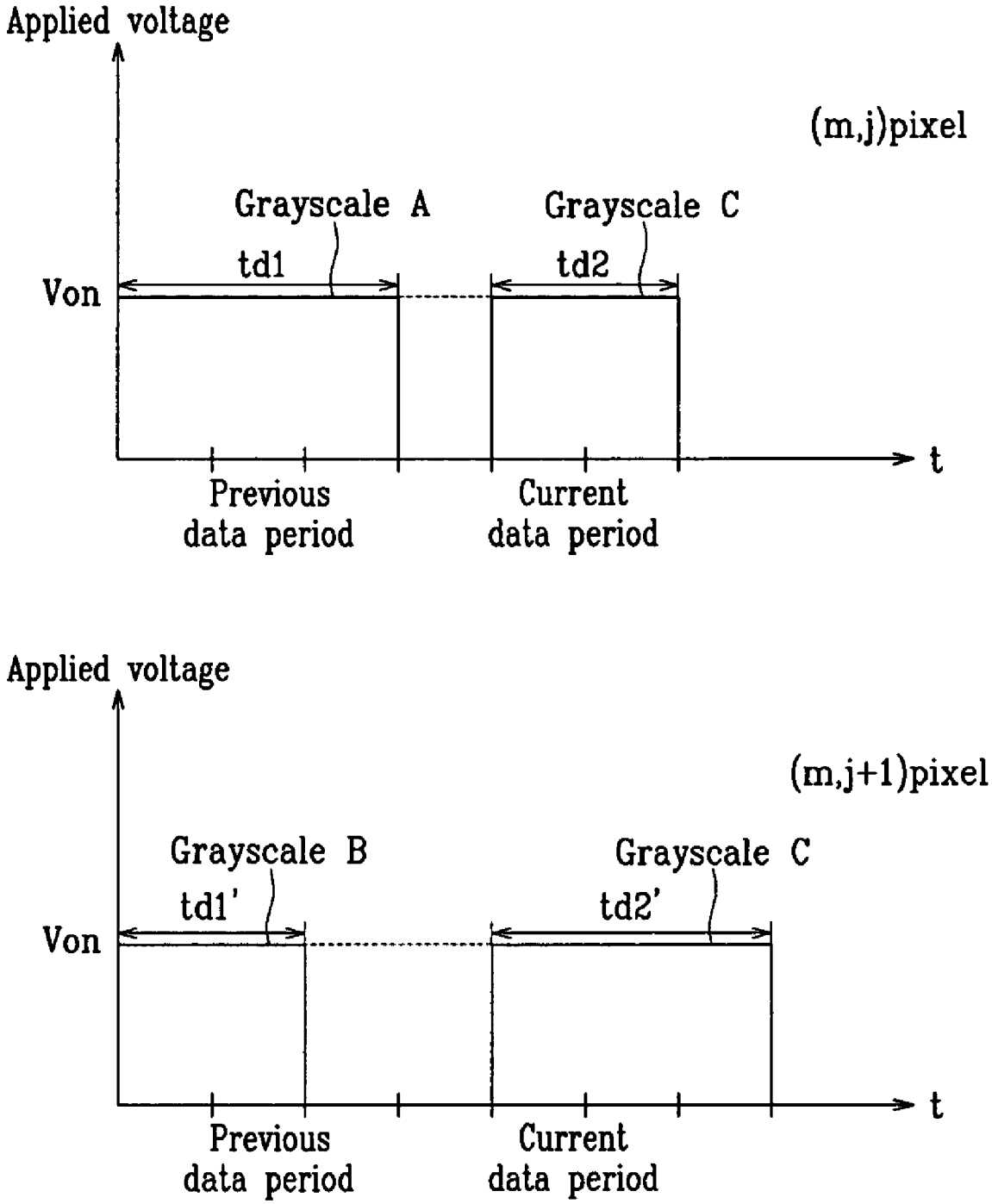
FIG. 8 illustrates a driving method of an LCD device according to a second exemplary embodiment of the present invention.

As shown in FIG. 8, the width td2 of a data waveform applied to (m, j) pixel (that is, a pixel corresponding to a data line Dm and a scan line Sj) and the width td2' of a data waveform applied to (m, j+1) pixel (that is, a pixel corresponding to a data line Dm and a scan line Sj+1) for expressing a current red light vary depending on a grayscale waveform applied to a previous pixel (e.g., a pixel for expressing blue).

In detail, according to the second exemplary embodiment of the present invention, the (m, j) pixel and the (m, j+1) pixel for expressing the current red light are intended to express a grayscale C, and the grayscale waveforms of the current pixels (m, j) and (m, j+1) are varied depending on the grayscale waveform of the previous pixel. When the width td1 of a data waveform applied to a previous pixel of the (m, j) pixel is relatively wide, the width td2 of a waveform applied to a current data period is relatively narrow to express the grayscale C, whereas the width td2' of a data waveform applied to the current data period is relatively wide when the width td1' of a data waveform applied to a previous pixel of the (m, j+1) pixel is relatively narrow to express the grayscale C. Luminance of a previous pixel is more likely to affect the expression of a grayscale of a current pixel when a relatively wide waveform is applied to a previous pixel compared to when a relatively narrow waveform is applied to the previous pixel. Such influence by the luminance of the previous pixel can be compensated by applying a relatively narrow waveform to the current pixel.

In other words, when grayscale waveforms respectively corresponding to grayscales A and B are applied to previous pixels and a grayscale waveform corresponding to grayscale C is applied to each of associated current pixels, grayscale waveforms applied to a current data period corresponding to a grayscale of the previous pixel are not the same but are different from each other to express the grayscale C. Since a grayscale of the previous pixel affects the grayscale of the current pixel, the waveform applied to the current pixel is set to be varied depending on the grayscale of the previous pixel.

As described, original grayscale data (herein, the grayscale C) of the current pixel is converted to another grayscale depending on grayscale data of the previous pixel. In other words, the original grayscale data of the current pixel is changed depending on the grayscale data of the previous pixel, and grayscale waveforms td2 and td2' corresponding to the changed grayscale data are applied to the current pixel as grayscale data thereof.

Thus, grayscales can be more accurately expressed according to the second exemplary embodiment of the present invention by compensating the grayscale data of the current pixel with reference to the grayscale of the previous pixel and applying a grayscale waveform corresponding to the compensated grayscale data of the current pixel.

Figure 9:
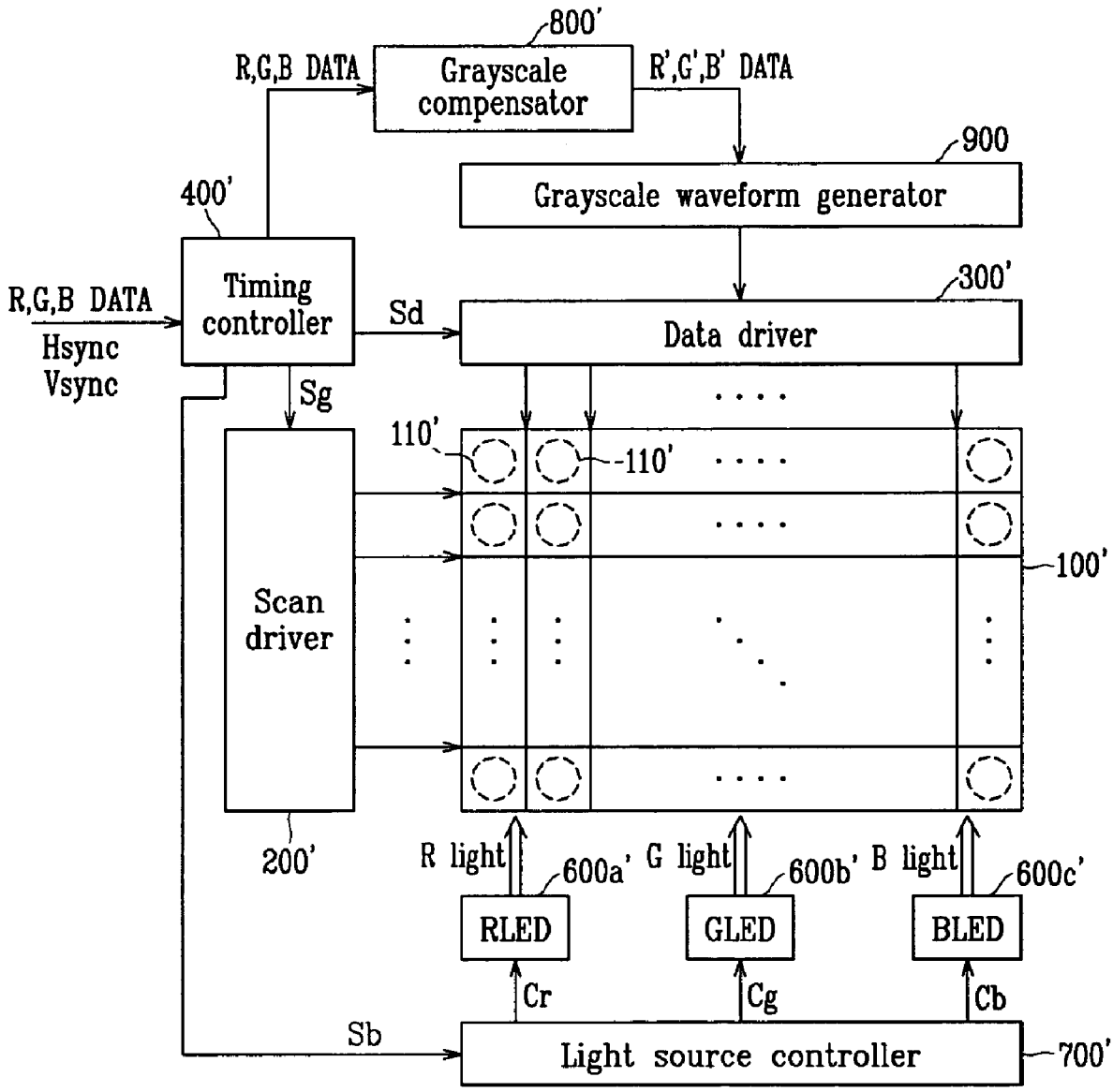
FIG. 9 and FIG. 10 illustrate an LCD device according to the second exemplary embodiment of the present invention.
Figure 10:
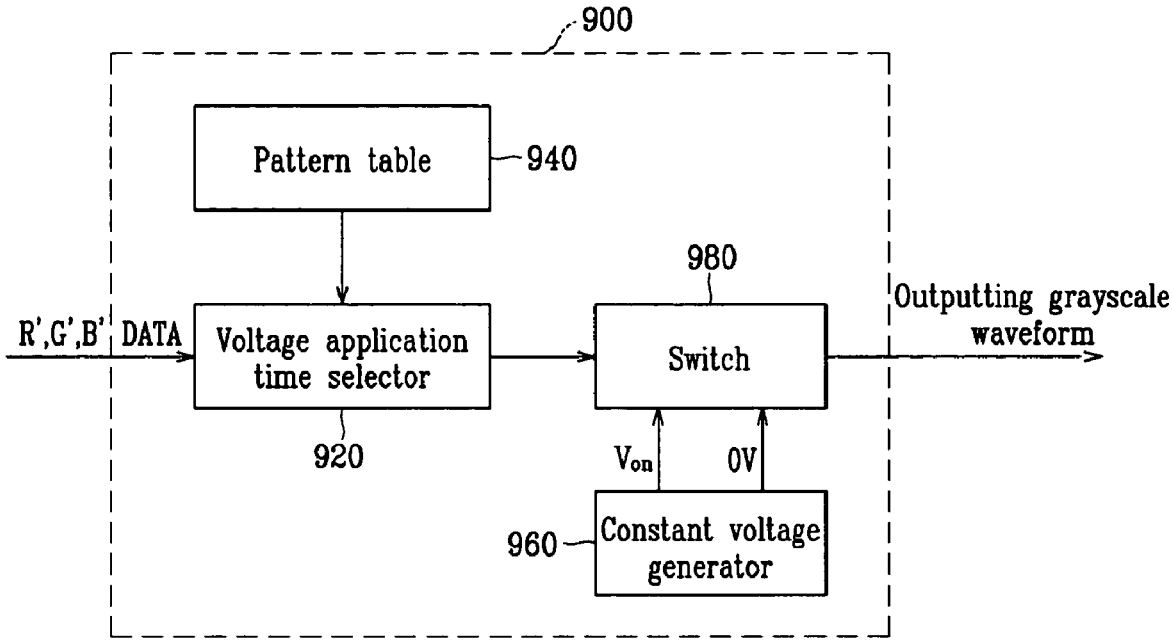

FIG. 9 and FIG. 10 illustrate an LCD device for applying the grayscale waveform of the current pixel corresponding to the grayscale data of the previous pixel according to the second exemplary embodiment of the present invention. As shown in FIG. 9, the LCD device according to the second exemplary embodiment of the present invention includes an LCD panel 100' having pixels 110', a scan driver 200', a data driver 300', a grayscale voltage generator 900, a timing controller 400', a red LED 600*a'*, a green LED 600*b'*, a blue LED 600*c'*, a light source controller 700', and a grayscale compensator 800'. Since many of the components illustrated in FIG. 9 operate in substantially the same manner as the corresponding components of FIG. 5, the detailed description related thereto will be omitted. The grayscale compensator 800' generates a grayscale waveform having a voltage width corresponding to grayscale data R', B', G' DATA compensated by the grayscale compensator 800', and supplies the grayscale waveform to the grayscale waveform generator 900. The data driver 300' applies a grayscale waveform outputted from the grayscale waveform generator 900 to a corresponding data line.

As shown in FIG. 10, the grayscale waveform 900 generator according to the second exemplary embodiment of the present invention includes a voltage application time selector 920, a pattern table 940, a constant voltage generator 960, and a switch 980.

The pattern table 940 stores grayscale waveform patterns (on/off patterns) corresponding to grayscale data. According to the second exemplary embodiment of the present invention, the pattern table 940 stores 4-bits on/off pattern corresponding to 6-bits grayscale data. For example, the on/off pattern '0100' (herein, '1' refers an on-waveform, and '0' refers an off-waveform) corresponds to the grayscale data '101111'.

The voltage application time controller 920 extracts a grayscale waveform pattern (on/off pattern) corresponding to compensated input grayscale data R', G', and B' DATA from the pattern table 940, and controls an on/off of the switch 980 and on/off timing of the switch 980 in accordance to the extracted grayscale waveform pattern. In detail, the voltage application time controller 920 turns on the switch 980 when the extracted grayscale waveform pattern is '1' to apply a first voltage Von to the switch to thereby maintain the liquid crystal in an on state for a predetermined time period, and turns off the switch to apply a second voltage of 0V to the switch to thereby maintain the liquid crystal in an off state for the predetermined time period. The constant voltage generator 960 generates the first and second voltages Von and 0V, and supplies the first and second voltages Von and 0V to the switch 980.

Depending on the control of the voltage application time controller 920, the switch 980 selects either the first voltage or the second voltage outputted from the constant voltage generator 960, and outputs the selected voltage to the data driver 300'.

Figure 11:
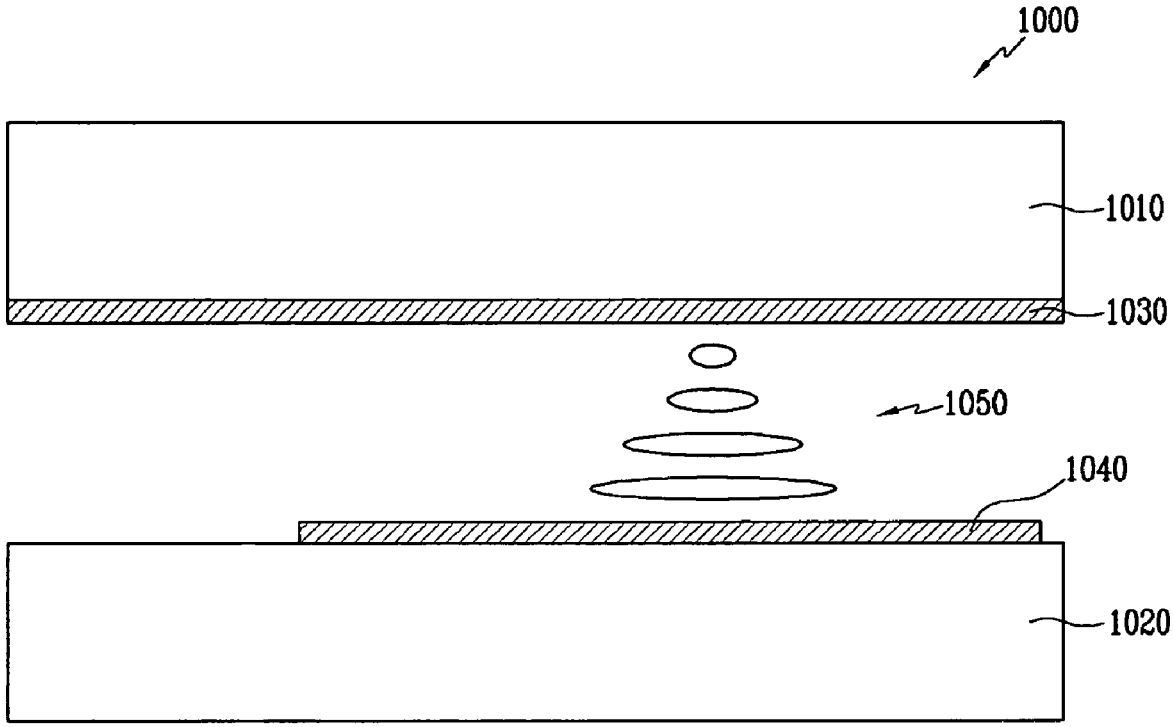
FIG. 11 illustrates a conceptual diagram of a pixel of a TFT-LCD.

FIG. 11 illustrates a conceptual diagram of a pixel 1000 of a TFT-LCD. The pixel includes a liquid crystal 1050 disposed between a first substrate 1010 and a second substrate 1020, a first electrode (common electrode) 1030 arranged at the first substrate 1010, and a second electrode (pixel electrode) 1040 arranged at the second substrate 1020. Exemplary embodiments of the present invention can be applied to the pixel of FIG. 11, as well as other suitable pixels. Further, the pixel 1000 can represent any of the pixels 110 of FIG. 5 and/or any of the pixels 110' of FIG. 9. In addition, the first and second substrates 1010, 1020 and the liquid crystal 1050 may be equivalently represented, for example, as the liquid crystal capacitor Cl in FIG. 1.

According to the present invention, luminance deviation of a current pixel resulted from a previous pixel is compensated to thereby express more precise grayscales by applying grayscale data (a grayscale voltage or a grayscale waveform) of a current pixel that varies depending on grayscale data of a previous pixel.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A driving method of a liquid crystal display device having a pixel formed by a liquid crystal disposed between a first substrate and a second substrate, red, green, and blue lights being sequentially transmitted to the pixel, the driving method comprising:

(a) applying first grayscale data for a first color to the pixel;

(b) compensating second grayscale data for a second color different from the first color to be applied to the pixel by changing the second grayscale data to third grayscale data for the second color in accordance with the first grayscale data and the second grayscale data; and (c) applying the third grayscale data to the pixel.

2. The driving method according to claim 1, wherein the second grayscale data is grayscale data to be applied to the pixel consecutively to the first grayscale data.

3. The driving method according to claim 1, wherein in (b), the second grayscale data is changed to lower grayscale data when the first grayscale data is relatively high as compared to when the first grayscale data is relatively low.

4. The driving method according to claim 1, wherein in (a) and (c), grayscale voltages respectively corresponding to the first grayscale data and the third grayscale data are applied to the pixel.

5. The driving method according to claim 1, wherein in (a) and (c), grayscale waveforms respectively corresponding to the first grayscale data and the third grayscale data are applied to the pixel.

6. The driving method according to claim 1, further comprising transmitting one of the red, green, and blue lights to the pixel when the first grayscale data is applied.

7. The driving method according to claim 6, further comprising transmitting a different one of the red, green, and blue lights to the pixel when the third grayscale data is applied.

8. The driving method according to claim 1, wherein compensating second grayscale data comprises storing the first grayscale data in a memory, and reading compensated grayscale data from a table using the first grayscale data from the memory and the second grayscale data, wherein the compensated grayscale data is the third grayscale data.

9. A driving method of a liquid crystal display device having first and second pixels formed by a liquid crystal disposed between a first substrate and a second substrate, red, green, and blue lights being sequentially transmitted to the pixels, the driving method comprising:

(a) applying first grayscale data for a first color to the first pixel;

(b) applying second grayscale data for a second color to the second pixel;

(c) after (a), when grayscale data to be applied to the first pixel is third grayscale data for a color different than the first color, compensating the third grayscale data to generate fourth grayscale data in accordance with the first grayscale data and the third grayscale data, and applying the fourth grayscale data to the first pixel; and (d) after (b), when grayscale data to be applied to the second pixel is the third grayscale data for a color different than the second color, compensating the third grayscale data to generate fifth grayscale data in accordance with the second grayscale data and the third grayscale data, and applying the fifth grayscale data to the second pixel, the fifth grayscale data being different from the fourth grayscale data.

10. The driving method according to claim 9, wherein when the first grayscale data has a grayscale level higher than that of the second grayscale data, the fourth grayscale data is set to have a grayscale level lower than that of the fifth grayscale data.

11. The driving method according to claim 9, further comprising transmitting one of the red, green, and blue lights to the first pixel when the first grayscale data is applied.

12. The driving method according to claim 11, further comprising transmitting a different one of the red, green, and blue lights to the first pixel when the fourth grayscale data is applied.

13. The driving method according to claim 9, further comprising transmitting one of the red, green, and blue lights to the second pixel when the second grayscale data is applied.

14. The driving method according to claim 13, further comprising transmitting a different one of the red, green, and blue lights to the second pixel when the fifth grayscale data is applied.

15. A liquid crystal display device comprising:

a liquid crystal display panel having a plurality of scan lines transmitting scan signals; a plurality of data lines crossing the scan lines while being insulated from the scan lines; and a plurality of pixels formed in areas defined by the scan lines and the data lines, and having switches respectively coupled to the scan lines and the data lines;

a gate driver sequentially supplying the scan signals to the scan lines;

a grayscale compensator compensating grayscale data to be applied to a current pixel of the pixels for a color based on grayscale data applied to a previous pixel of the pixels for a different color;

a data driver driving an associated one of the data lines corresponding to the grayscale data compensated by the grayscale compensator; and a light source sequentially emitting red, green, and blue lights to the pixels.

16. The liquid crystal display device according to claim 15, wherein the grayscale compensator comprises:

a memory storing the grayscale data corresponding to the previous pixel;

a table storing compensated grayscale data corresponding to the grayscale data of the previous pixel and the current pixel; and a grayscale converter selecting the compensated grayscale data stored in the table using the grayscale data of the previous pixel stored in the memory and the grayscale data of the current pixel.

17. The liquid crystal display device according to claim 15, further comprising a grayscale voltage generator generating a grayscale voltage corresponding to the grayscale data compensated by the grayscale compensator, and supplying the grayscale voltage to the data driver.

18. The liquid crystal display device according to claim 15, further comprising a grayscale waveform generator generating a grayscale waveform corresponding to the grayscale data compensated by the grayscale compensator, and supplying the grayscale waveform to the data driver.

19. The liquid crystal display device according to claim 15, wherein the grayscale compensator compensates current grayscale data to be applied to a first one of the pixels and current grayscale data to be applied to a second one of the pixels to be different from each other when previous grayscale data applied to the first one of the pixels and the second one of the pixels are different from each other and the current grayscale data to be applied to the first and second pixels are the same.

20. The driving method according to claim 1, wherein the first color corresponds to one of the red, green, or blue lights, the second color corresponds to a different one of the red, green, or blue lights, and wherein in (b), the second grayscale data is changed to the third grayscale data in accordance with both the first grayscale data for the first color and the second grayscale data for the second color.

* * * * *